US011352731B2

(12) United States Patent
McDonald et al.

(10) Patent No.: US 11,352,731 B2
(45) Date of Patent: Jun. 7, 2022

(54) CONTAMINATION RESISTANT APPLIANCE LATCH

(71) Applicant: Illinois Tool Works Inc., Glenview, IL (US)

(72) Inventors: Randy S. McDonald, Sussex, WI (US); Jeffrey J. Krieger, Mukwonago, WI (US); Michael K. Hintz, Waukesha, WI (US)

(73) Assignee: Illinois Tool Works Inc., Glenview, IL (US)

( * ) Notice: Subject to any disclaimer, the term of this patent is extended or adjusted under 35 U.S.C. 154(b) by 779 days.

(21) Appl. No.: 16/009,947

(22) Filed: Jun. 15, 2018

(65) Prior Publication Data

US 2018/0371800 A1 Dec. 27, 2018

Related U.S. Application Data

(60) Provisional application No. 62/593,720, filed on Dec. 1, 2017, provisional application No. 62/522,977, filed on Jun. 21, 2017.

(51) Int. Cl.
*E05B 65/00* (2006.01)
*E05B 47/00* (2006.01)
(Continued)

(52) U.S. Cl.
CPC ..... *D06F 37/42* (2013.01); *E05B 17/002* (2013.01); *E05B 17/0062* (2013.01);
(Continued)

(58) Field of Classification Search
CPC ..... D06F 37/28; D06F 39/14; D06F 23/04; D06F 2224/00; D06F 37/42; E05B 65/00;
(Continued)

(56) References Cited

U.S. PATENT DOCUMENTS 3,627,960 A * 12/1971 Grabek ..... H01H 3/163 292/144
3,803,575 A * 4/1974 Gotanda ..... E05B 45/083 292/DIG. 65
(Continued)

FOREIGN PATENT DOCUMENTS

CN 1861970 A 11/2006
CN 201058932 Y 5/2008
(Continued)

OTHER PUBLICATIONS

Computer Generated Translation for DE 19848275 A1, Translated on Mar. 16, 2021, https://worldwide.espacenet.com/ (Year: 2021).*

*Primary Examiner* — Alyson M Merlino
(74) *Attorney, Agent, or Firm* — Boyle Fredrickson, S.C.

(57) ABSTRACT

An appliance lid lock mechanism provides a lock pin that may be extended into or withdrawn out of a lock cavity that receives a strike attached to the appliance lid interacting with the lock pin when the lid is closed. The lock pin communicates with the electric actuator on the opposite side of the lock pin from the lock pin's entry into the lock cavity by means of sidebars passing to the side of the lock cavity. The lock bar and sidebars are substantially coplanar with an actuation axis to prevent passage of liquid along these elements between the lock pin and the actuator.

20 Claims, 6 Drawing Sheets

(51) Int. Cl.

| | |
|---|---|
| ***D06F 39/14*** | (2006.01) |
| ***D06F 34/20*** | (2020.01) |
| ***D06F 37/42*** | (2006.01) |
| ***E05B 41/00*** | (2006.01) |
| ***E05B 17/00*** | (2006.01) |
| *D06F 23/04* | (2006.01) |
| *E05B 17/22* | (2006.01) |
| *D06F 103/40* | (2020.01) |

(52) U.S. Cl.
CPC ..... *E05B 41/00* (2013.01); *E05B 47/0001* (2013.01); *E05B 47/0046* (2013.01); *E05B 65/00* (2013.01); *D06F 23/04* (2013.01); *D06F 34/20* (2020.02); *D06F 39/14* (2013.01); *D06F 2103/40* (2020.02); *E05B 17/22* (2013.01); *E05B 2047/0081* (2013.01)

(58) Field of Classification Search
CPC ..... E05B 17/002; E05B 17/0054; E05B 17/0062; E05B 17/22; E05B 17/00; E05B 17/0029; E05B 41/00; E05B 15/022; E05B 15/026; E05B 47/0001; E05B 47/0046; E05B 2047/0081; E05B 2047/0079; Y10T 292/1021; Y10T 292/696; Y10T 292/699; Y10S 292/53; Y10S 292/54; Y10S 292/64; Y10S 292/65; Y10S 292/69
See application file for complete search history.

(56) References Cited

U.S. PATENT DOCUMENTS

| | | | | |
|---|---|---|---|---|
| 7,900,979 | B2 * | 3/2011 | Bragg | D06F 37/42 292/DIG. 69 |
| 2007/0144880 | A1 | 6/2007 | Bragg et al. | |
| 2018/0008120 | A1 * | 1/2018 | Dirnberger | D06F 37/42 |

FOREIGN PATENT DOCUMENTS

| | | | | |
|---|---|---|---|---|
| CN | 102337804 | A | 2/2012 | |
| CN | 102575489 | A | 7/2012 | |
| CN | 105054810 | A | 11/2015 | |
| DE | 4032677 | A1 | 4/1992 | |
| DE | 19848275 | A1 * | 4/2000 | D06F 37/42 |
| DE | 10320058 | A1 * | 12/2004 | E05B 85/10 |
| EP | 1544387 | A2 * | 6/2005 | E05B 17/22 |
| JP | 2008063807 | A * | 3/2008 | |
| JP | 2016187367 | A | 11/2016 | |
| KR | 20020001084 | A * | 1/2002 | |
| WO | 2015084488 | A1 | 6/2015 | |

* cited by examiner

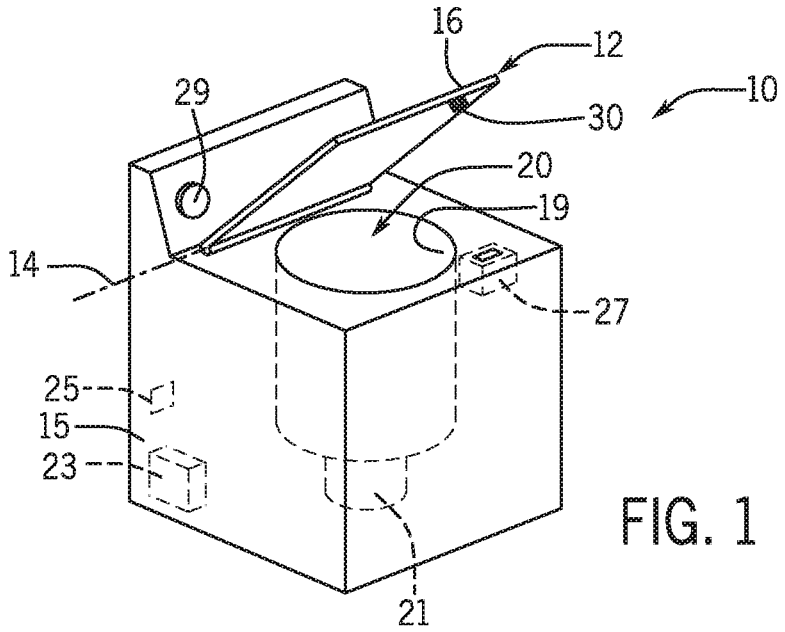
FIG. 1
FIG. 2
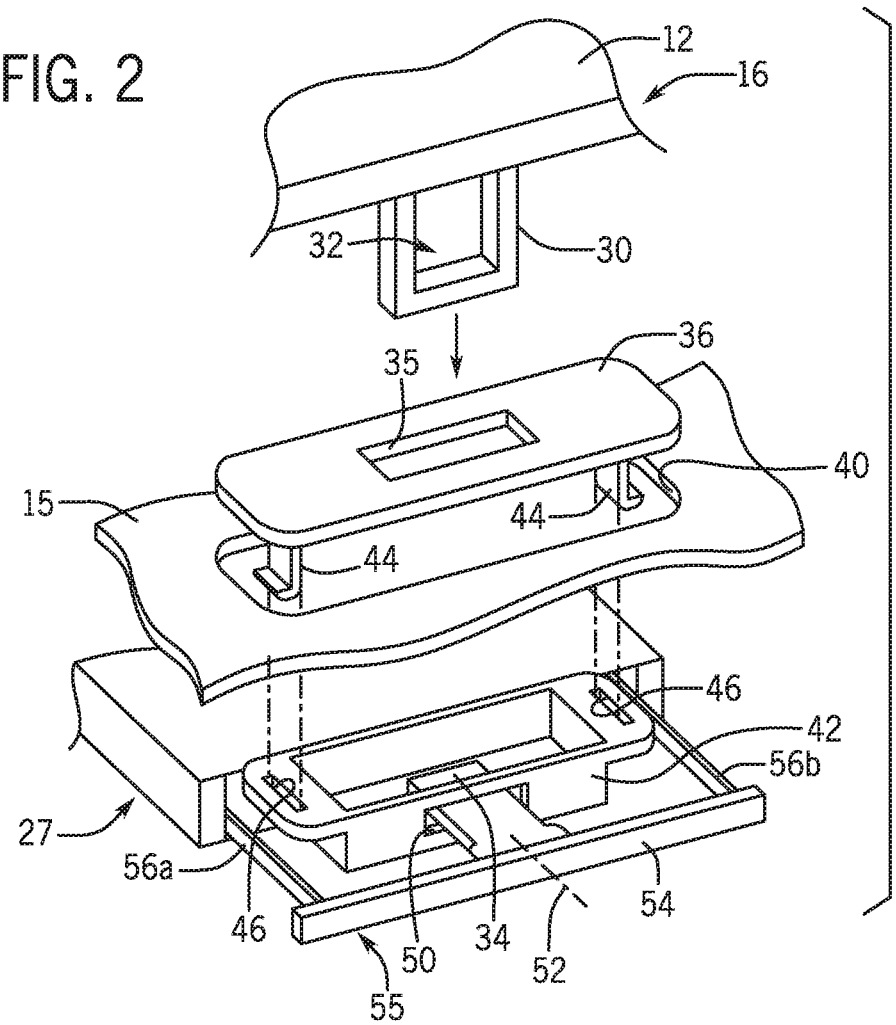

CONTAMINATION RESISTANT APPLIANCE LATCH

CROSS-REFERENCE TO RELATED APPLICATIONS

This application claims the benefit of U.S. Provisional application 62/593,720 filed Dec. 1, 2017, and U.S. Provisional application 62/522,977 filed Jun. 21, 2017, both hereby incorporated by reference in their entireties.

FIELD OF THE INVENTION

The present invention relates to home appliances such as clothes washing machines and the like and, in particular, to a lid locking mechanism with improved resistance to contamination.

BACKGROUND OF THE INVENTION

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine lid in the closed position. U.S. Pat. Nos. 6,363,755; 5,823,017; and 5,520,424, assigned to the present assignee and hereby incorporated by reference, describe several such locks.

These locks may employ a locking mechanism held within the housing of the appliance and providing an opening in the appliance housing through which a strike element, for example, attached to the appliance door, may be received. A lock pin extending from the locking mechanism may engage the strike element when the strike element passes through the opening preventing the lid from opening.

The lock pin is typically operated by an electric actuator within the locking mechanism. While this actuator is largely protected behind the housing of the appliance, liquid, such as water, bleach, fabric softener, and detergent, spilled on the opening that receives the strike element can be conducted along the lock pin into the locking mechanism causing damage or failure of the locking mechanism and its components.

It is generally known to use O-ring type seals or the like to prevent the movement of liquid along sliding surfaces, but such seals can interfere with movement of the lock pin, particularly if contaminants build up along close fitting sliding surfaces between the lock pin and such seals. Elastic bellows or the like can also be used to block liquid ingress, but such seals can be subject to premature failure or damage from the lock strike.

SUMMARY OF THE INVENTION

The present invention provides a lock pin that is largely unconstrained by seals or bellows but instead prevents liquid ingress by using a serpentine actuator link which would require liquid to flow both uphill and downhill in two opposite directions along generally coplanar link components, such as is unlikely to occur by force of gravity alone. By permitting loosely spaced guides around the lock pin, blockage of the lock pin by buildup of contamination is unlikely.

Specifically, in one embodiment, the invention provides an appliance lock for retaining a lid strike attached to a hinged lid of an appliance, the hinged lid opening to provide access to a washing cavity when the appliance lock is unlocked. The appliance lock includes a housing providing a compartment for receiving the lid strike when the hinged lid is closed, and a lock pin adapted to slide into the compartment to engage the lid strike from a first side of the compartment. An electric actuator communicates with the lock pin to move the lock pin along an actuation axis, the electric actuator positioned on a second side of the compartment opposite to the first side.

It is thus a feature of at least one embodiment of the invention to position the electric actuator in opposition to the lock pin so that the electric actuator can be better separated from an aperture through which the lock pin extends.

The electric actuator may communicate with the lock pin through a linkage extending away from the electric actuator along a first direction within a plane of the actuation axis and the lock pin may attach to the linkage to extend along a second direction within the plane of the actuation axis opposite the first direction.

It is thus a feature of at least one embodiment of the invention to provide a serpentine path that includes uphill and downhill portions, if there is any slope in the installation of the actuator, between the electric actuator and the lock pin making it difficult for liquid to travel under the influence of gravity from an end of the lock pin to the electric actuator.

The linkage may provide first and second linkage arms together flanking the lock pin and passing on opposite sides of the compartment.

It is thus a feature of at least one embodiment of the invention to provide a balanced application of force between the electric actuator and the lock pin when so removed.

The lock pin and linkage may have lower surfaces that extend along parallel planes.

It is thus a feature of at least one embodiment of the invention to eliminate a continuous downhill path from a distal end of the lock pin to the electric actuator.

The compartment may have upstanding sidewalls defining a volume therebetween with only a single opening through an upstanding sidewall, that opening for admitting the lock pin.

It is thus a feature of at least one embodiment of the invention to reduce water exiting from the compartment such as may be introduced through a bezel.

The compartment may be open at the bottom and separated from the electric actuator by an unbroken vertical wall.

It is thus a feature of at least one embodiment of the invention to provide a drainage from the compartment further decreasing the risk of water transmission to the electric actuator and its associated circuitry.

In one embodiment, the invention may provide an appliance lock for retaining a lid strike attached to a hinged lid of an appliance, the hinged lid opening to provide access to a washing cavity when the appliance lock is unlocked. In this embodiment, the appliance lock includes a lock pin assembly having a lock pin movable between a first position engaging a strike when the strike is positioned proximate to the lock pin and a second position disengaging from the strike when the strike is positioned proximate to the lock pin. An electric actuator communicates with the lock pin to move the lock pin between the first and second positions and a safety catch blocks movement of the lock pin assembly from the second position to the first position when the lock pin is damaged.

It is thus a feature of at least one embodiment of the invention to provide a method of detecting a breakage of the lock pin such as may affect the ability of the lock to protect the consumer from possible hazards within the appliance.

The lock pin may include a weakened section promoting breakage at a predetermined location, and the breakage of the lock pin at the weakened section allows relative movement of the lock pin assembly and safety catch so that the safety engages with the lock pin assembly when the actuator is actuated limiting motion of the lock pin assembly.

It is thus a feature of at least one embodiment of the invention to provide a simple mechanical method of detecting damage to the lock pin by promoting breakage and providing a mechanical breakage detection.

The catch and lock pin assembly may be biased into engagement under the influence a spring.

It is thus a feature of at least one embodiment of the invention to provide a positive interaction between the catch and lock pin for detecting of lock pin damage.

The spring may bias the lock pin into a retracted state from the strike.

It is thus a feature of at least one embodiment of the invention to make use of the pre-existing lock pin retraction spring for biasing of the safety catch and lock pin together.

The spring may be positioned offset from a line of action of the actuator to impart a torsion to the lock pin assembly causing engagement of the catch and lock pin assembly when the lock pin is broken.

It is thus a feature of at least one embodiment of the invention to promote movement of the lock pin assembly out of its normal trajectory so as to permit engagement between the lock pin assembly and a catch fixed with respect to the housing for improved strength and simplicity.

The catch may be a portion of an aperture through which the lock pin passes.

It is thus a feature of at least one embodiment of the invention to provide a safety catch mechanism that can also detect distortion damage of the lock pin or encrustation of the lock pin such as also may prevent locking action.

The catch and lock pin assembly may be biased into engagement by gravity.

It is thus a feature of at least one embodiment of the invention to provide an extremely reliable biasing mechanism that does not rely on a possibly damaged or broken spring.

The appliance lock may further include an electrical switch communicating with the lock pin indicating failure of the lock pin to fully extend when the lock pin assembly is caught by the catch.

It is thus a feature of at least one embodiment of the invention to provide an electrical signal to the appliance control to prevent dangerous operation of the appliance if locking abilities are compromised.

The electric actuator may be a solenoid.

It is thus a feature of at least one embodiment of the invention to provide a fast-acting actuator that may be energy-saving when combined with a bi-stable linkage mechanism.

One embodiment of the invention may provide an appliance lock for retaining a lid strike attached to a hinged lid of an appliance, the hinged lid opening to provide access to a washing cavity when the appliance lock is unlocked where the appliance lock includes a lock pin movable between a first position engaging a strike positioned proximate to the lock pin and second position disengaging from the strike positioned proximate to the lock pin. A bi-stable electrical actuator assembly may move the lock pin between the first and second positions upon successive activations of the bi-stable electrical actuator. In this embodiment, a lock pin stop may block movement of the lock pin from the second position to the first position in a shipping state and allowing movement of the lock pin from the second position to the first position in an assembled state. A key interacting with the lock pin blocking stop may move the lock pin stop from the shipping state to the assembled state.

It is thus a feature of at least one embodiment of the invention to permit the advantages of a bi-stable mechanism for energy savings while preventing accidental locking of the lock during shipment with shipment shocks.

The key may be a feature on a bezel attached to the appliance lock when the appliance lock is installed on the appliance to provide an opening through which the strike may pass when the hinged lid of the appliance is closed and the strike moves to the position proximate to the lock pin.

It is thus a feature of at least one embodiment of the invention to provide a simple mechanism of automatically deactivating the shipping lock during assembly of the lock mechanism with a bezel.

The lock pin may engage the strike within a partially enclosed compartment and may include a stop removably positionable within the compartment location proximate to the lock pin for blocking extension of the lock pin to that location.

It is thus a feature of at least one embodiment of the invention to provide two levels of mis-triggering protection, one for addressing more likely shocks incident to the separate lock mechanisms in transit and automatically disabled by installation and the second one for handling less likely shocks in the shipment of the appliance to the consumer.

In one embodiment, the invention may provide an appliance lock for retaining a lid strike attached to a hinged lid of an appliance, the hinged lid opening by pivoting about a hinge axis to provide access to a washing cavity when the appliance lock is unlocked. The appliance lock may include a strike attached to the lid and extending in a direction perpendicular to the hinge axis and having a curvature following a constant radius about the hinge axis. A lock pin may be between the first position engaging the strike when the strike is at a predetermined position proximate to the lock pin and second position disengaging from the strike when the strike is at the predetermined position proximate to the lock pin, and a strike sensor may sense a position of the strike when the strike is located to receive the lock pin.

It is thus a feature of at least one embodiment of the invention to provide a strike that can implement the close clearances with the lock mechanism for highly reliable strike sensing.

The strike provides a magnet and the strike sensor may be a magnet sensor for sensing the position of the strike when the strike is located to receive the lock pin.

It is thus a feature of at least one embodiment of the invention to provide a lid sensor that is resistant to actions to defeat the lid sensor mechanically, for example, by insertion of a stick or the like.

The strike sensor and magnet are positioned so that the strike sensor does not sense the position of the strike as located to receive the lock pin if the strike is blocked from that position by the lock pin at the first position.

It is thus a feature of at least one embodiment of the invention to provide sensitive discrimination of the strike position possible with close clearances provided by using a curved strike.

Other features and advantages of the invention will become apparent to those skilled in the art upon review of the following detailed description, claims and drawings in which like numerals are used to designate like features.

BRIEF DESCRIPTION OF THE DRAWINGS

FIG. 1 is a perspective view a washing machine incorporating one embodiment of the lid lock assembly of the present invention, showing location of the lock mechanism within the washing machine and a strike attached to the lid of the washing machine to engage the lock mechanism when the lid is closed;

FIG. 2 is a perspective, fragmentary view of the lock mechanism in exploded form showing the strike before engagement with the lock mechanism and showing a lock pin in the lock mechanism in the retracted position that can later engage the strike;

Figure 3:
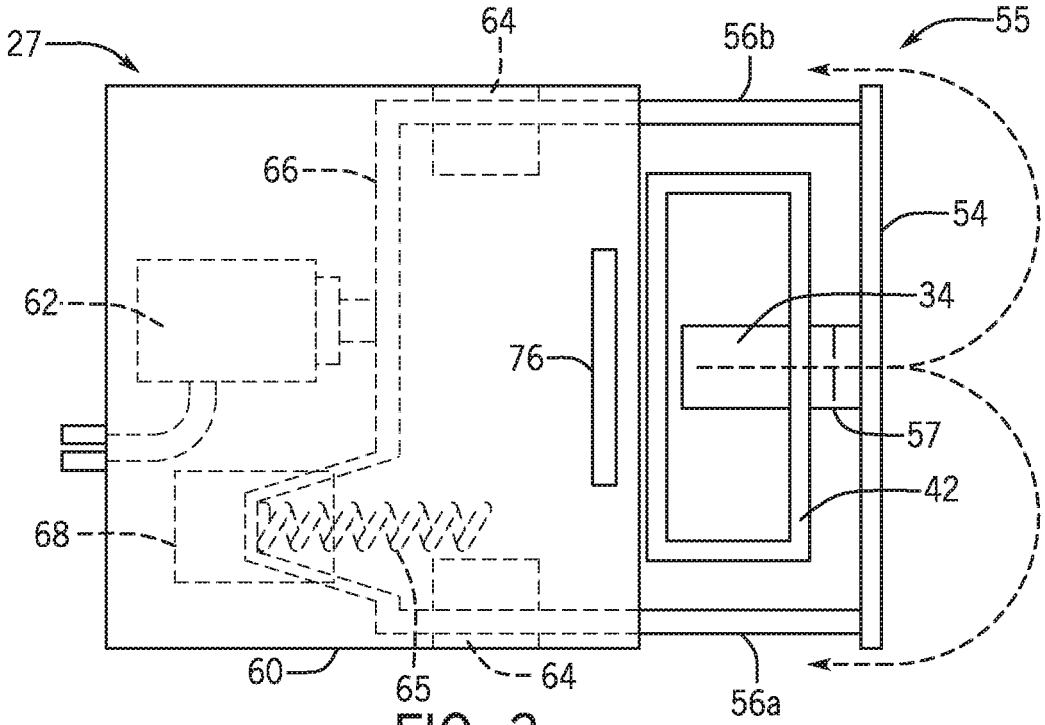
FIG. 3 is a top plan view of the locking mechanism of FIG. 2 showing the lock pin assembly and the two countervailing directions that liquid would need to flow to be conducted from the lock pin back into the lock mechanism housing.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of"including" and "comprising" and variations thereof is meant to encompass the items listed thereafter and equivalents thereof as well as additional items and equivalents thereof.

DETAILED DESCRIPTION OF THE PREFERRED EMBODIMENT

Referring now to FIG. 1, an appliance 10, such as a top-loading washing machine suitable for use with the present, invention may include a door 12 opening upward about a horizontal lid hinge axis 14 with respect to an appliance housing 15. The lid hinge axis 14 is positioned near the top rear edge housing 15 of the appliance 10 so that a front edge 16 of the door 12 may raise and lower to expose or cover an opening 20 through which clothing may be inserted into the spin basket 19. A front-loading washing machine (not shown) is also suitable for use with the present invention as will be apparent to those of ordinary skill in the art from the following description with an appropriate adjustment of the orientation.

The appliance 10 may include a motor transmission unit 21 and water handling valve unit 23 positioned within the housing 15 that operate together to control water flow into the spin basket 19 and to agitate clothing therein for washing under the control of a controller 25. The controller 25 may also receive user commands to console controls 29 as is generally understood in the art and may communicate with a lid lock assembly 27 as will be discussed below to lock or unlock the door 12 during operation of appliance 10 for consumer safety. In particular, the controller 25 may lock the door 12 during a high-speed spin cycle and may prevent entry into the spin cycle if failure of that locking is detected.

Referring now also to FIG. 2, the front edge 16 of the door 12 may support a downwardly extending lock strike 30 providing generally a loop-form having an opening 32 passing therethrough along a direction intersecting the hinge axis 14. The lock assembly 27 provides a lock pin 34 that may, when the door 12 is closed, extend through the opening 32 to retain the door 12 in closed position or which may be withdrawn from the opening 32 so that the door 12 may be opened.

More specifically, as the door 12 is closed, the lock strike 30 may pass downward through an opening 35 in a bezel 36 positioned on an outer surface of the housing 15. The opening 35 of the bezel 36 is aligned with a corresponding opening 40 in the housing 15 of the appliance 10 that allows passage of the lock strike 30 downwardly into an upwardly open lock chamber 42 forming part of the lid lock assembly 27 within the housing 15. When the lock strike 30 is within the lock chamber 42, the lock pin 34 may move horizontally rearward to engage the opening 32 of the lock strike 30. In a preferred embodiment, a lower wall of the 2 is open to allow drainage therethrough.

The bezel 36 may have downwardly extending locking tabs 44 at left and right ends of the bezel 36 that also pass through the opening 40 in the housing 15 to be received by corresponding tab slots 46 of the lid lock assembly 27 extending on the left and right side of the lock chamber 42. The locking tabs 44 engage with the tab slots 46 to lock the bezel 36 to the lock chamber 42 so that the housing 15 around the opening 40 is sandwiched between the under surface of the bezel 36 and the upper surface of the lock chamber 42. Lower ends of the locking tabs 44 may have hooks that are biased inward or outward to retain the locking tabs 44 in place once the bezel 36 is installed.

Referring still to FIG. 2, a distal end of the lock pin 43 may enter lock chamber 42 through an oversized opening 50 in a front wall of the lock chamber 42 and may extend and retract along a generally horizontal axis 52 extending from the front to the rear of the appliance 10. In one embodiment, the lock chamber 41 has only one opening in the upstanding sidewalls of the lock chamber 41 (on the front wall) to otherwise minimize the passage of liquid (water or cleaning aids) from inside the lock chamber 42, for example, through opening 35, to outside of the lock chamber when the water is introduced through the opening 35.

The proximal end of the lock pin 43 outside of the lock chamber 42 attaches to a front crossbar 54 extending horizontally to the left and right of the lock pin 34 on either side of the lock chamber 42. The opposite ends of the front crossbar 54 each attach to rearwardly, horizontally extending sidebars 56*a* and 56*b* passing rearwardly therefrom on the left and right side of the lock chamber 42, respectively. Together the lock pin 43, front crossbar 45, and sidebars 56 make up a lock pin frame 55.

The sidebars 56*a* and 56*b* are slidably received within a lock housing 60 abutting a rear surface of the lock chamber 42. The lock chamber 42 and actuator housing 60 may be a single integrated injection-molded part to facilitate assembly of these units. The lock housing 60 may hold an electric actuator 62 for actuating the lock pin 34 under control of the controller 25 (shown in FIG. 1). The actuator 62 may be any of a variety of actuator types including a spring-biased monostable solenoid, a bi-stable solenoid, a wax motor, and a bimetallic strip. As depicted the actuator 62 is a standard pull-in type solenoid operable using alternating current at line voltages. The lock housing 60 may also hold other electronic circuit components including a door sensor or the like that determine whether the door 12 is closed and that provide a signal to the controller 25, as will be discussed, as well as electrical connectors and other switches. As such, it is important to shield the contents of the lock housing 60 from moisture and contaminants.

Inside of the lock housing 60, sidebars 56*a* and 56*b* are received through slide fittings 64 allowing forward and rearward motion of the sidebars 56*a* and 56*b* with respect to the lock housing 60 and thus similar motion of the lock pin 34 along the horizontal axis 52 in translation. The slide fittings 64 are sized to also permit small amounts of twisting or tipping of the lock pin frame 55. During normal use, such twisting is prevented by a collar 57 fitting about the lock pin 34 and guiding the lock pin, and hence the lock pin frame 55, in translation.

Within the lock housing 60, the sidebars 56*a* and 56*b* may join to a yoke 66 completing the lock pin frame 55. The yoke 66 communicates with the electric actuator 62 so that the electric actuator 62 may operate to pull both sidebars 56*a* and 56*b* in unison in a direction into the housing 60 to lock the door 12 by having the lock pin 34 pass into the lock chamber 42 to enter the opening 32 of the strike 30. An internal spring 65 communicates between the housing and the yoke 66 to generally bias the lock pin 34 out of the lock chamber 42 so that when the electric actuator 62 is actuated, the strike 30 may be released. In a preferred embodiment, motion of the lock pin frame 55 is constrained by a bi-stable mechanism (discussed below) causing movement between an unlocked and locked state with each sequential energization and deenergization of the electric actuator 62.

It will be understood that liquid introduced into the lock chamber 42 through the opening 35 of the bezel 36 may drain therethrough, for example, into the washtub through an open bottom of the lock chamber 42. Some of this liquid, however, may contact the lock pin 34 either in the locked or unlocked position and may travel along the lock pin 34 from its distal end toward its proximal end toward the front of the appliance 10, for example, retained on the under surface of the lock pin 34 by capillary action. In order for that introduced liquid to be conducted along the crossbar 54 and back along the sidebars 56, however, the liquid would have to reverse the direction of travel something that is unlikely because the lock pin 34 and the sidebars 56*a* and 56*b* are designed to extend along parallel planes or to be coplanar. Specifically, because captured liquid will generally follow along the under sides of the lock pin 34 and sidebars 56 held by capillary action, these lower surfaces may be designed to be parallel.

Figure 4:
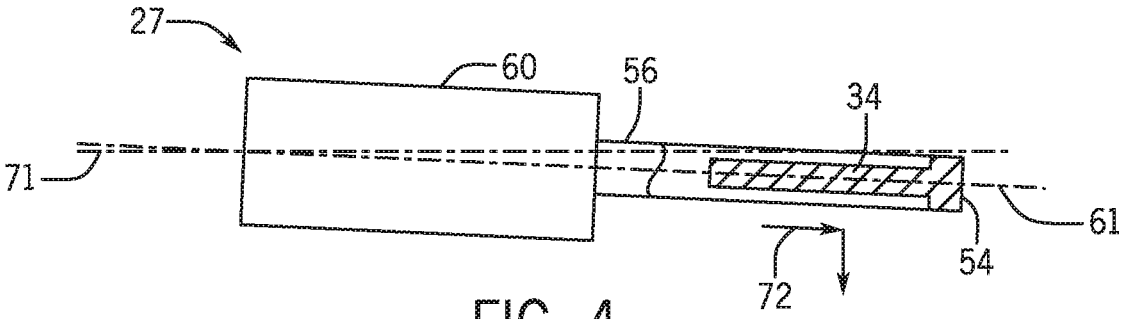
FIGS. 4 and 5 are side elevational views of the lock mechanism of FIG. 3 in partial cross-section showing directions of liquid flow with slight tipping of the mounting of the lock mechanism such as may occur during normal manufacturing processes or appliance positioning.

Referring now to FIG. 4, it will be appreciated that if during installation of the appliance 10 or manufacture thereof, the lock assembly 27 is tipped so that sidebars 56 and lock pin 34 extend downward toward the front of the appliance 10 with respect to a horizontal axis 71, any liquid introduced onto the lock pin 34 will generally travel forward as indicated by arrow 72 to collect on the underside of the crossbar 54 eventually to drop off at that point having no path further forward. This liquid cannot move backward along the sidebars 56 into the housing 60 to the yoke 66 because it would need to travel uphill.

Figure 5:
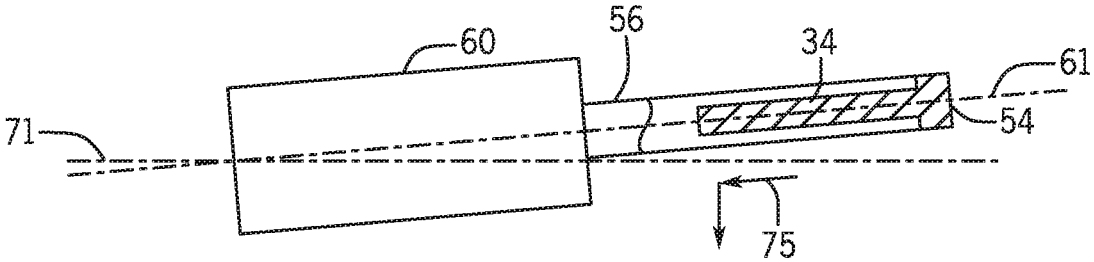

Conversely, and referring now to FIG. 5, if because of installation of the appliance 10 or manufacture, the lock assembly 27 is tipped so that the sidebars 56 and lock pin 34 travel slightly upward toward the front of the appliance 10 with respect to the horizontal axis 71, any liquid introduced onto the lock pin 34 will generally travel backward as indicated by arrow 75 reaching the cantilevered distal end of the lock pin 34 to drop off of the lock pin 34 having no further path rearward. This liquid is isolated from the sidebars 56 preventing the liquid from traveling along those sidebars 56 into the housing 60.

Generally, the sidebars 56 and the lock pin 34 extend along parallel planes that are also parallel to an actuation axis 61 defining a direction of movement of the lock pin assembly and an axis of movement of the solenoid 62 (shown in FIG. 3).

Referring again to FIG. 3, as noted above, the yoke 66 may communicate with a bi-stable mechanism 68 allowing each actuation of the actuator 62 to stably position the lock pin successively in either the engaged position shown in FIG. 3 or the disengaged position shown in FIG. 2 outside of the lock chamber 42. A cardioid track mechanism for implementing such a bi-stable open and close mechanism is described in US patent application 2015/0240527 assigned to the assignee of the present application and hereby incorporated by reference.

Figure 6:
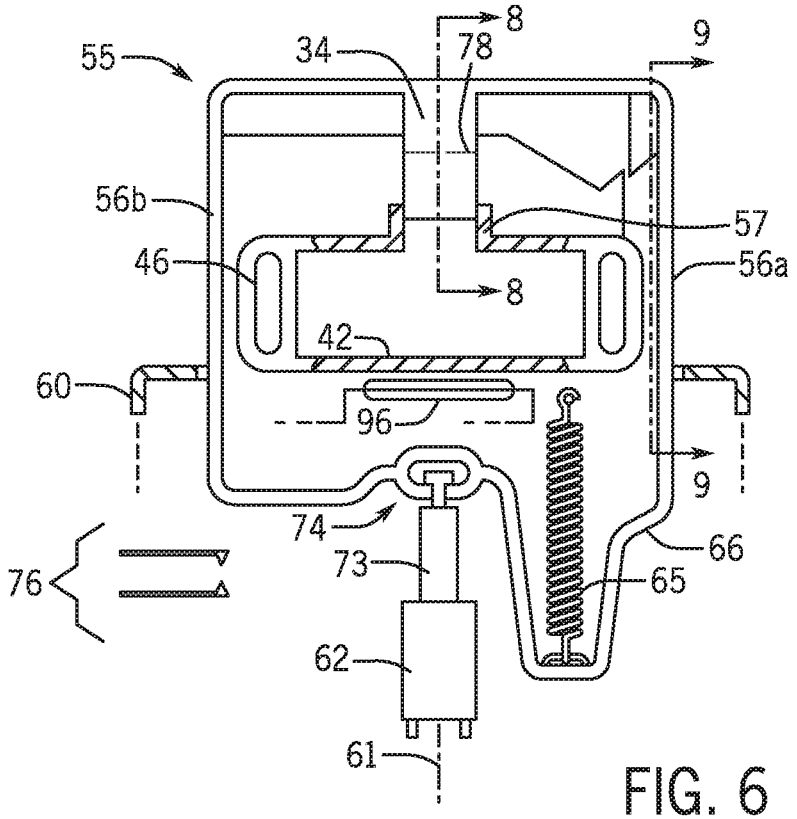
FIG. 6 is a figure similar to FIG. 3 showing a lock chamber receiving the strike, the lock chamber having a collar supporting the lock pin as it moves into and out of the lock chamber and showing the lock pin assembly supporting the lock pin and extending within a housing of the lock mechanism to be attached to an electric actuator and an off-center spring.

Referring now to FIG. 6, the actuator 62 may have a plunger 73 attached to the yoke 66 by a swivel coupling 74 restraining the yoke 66 to the plunger 73 with respect to translation along axis 61 but providing some ability of the yoke 66 and the lock pin frame 55 to tip with respect to the linear motion of the end of the plunger 73. Activation of the actuator 62 pulls the plunger 73 in a direction moving the lock pin 43 into the lock cavity 47. The swivel coupling 74 is generally mounted midway between the sidebars 56 of the lock pin frame 55 to apply a force evenly between the sidebars 56.

A helical extension spring 65 is mounted between the yoke 66 and the housing 60 to provide a biasing of the lock pin frame 55 in the opposite direction tending to move the lock pin 43 out of the lock cavity 47. Importantly, the spring 65 is mounted off center with respect to the plunger 73 to be somewhat closer to sidebar 56*a*. During normal operation, when the lock pin 34 is undamaged, this slight offset between the spring 65 and the plunger 73 does not affect movement of the lock pin frame 55 which translates smoothly along axis 61 to move the lock pin 43 into and out of the lock cavity 47. During this normal operation, when the lock pin 34 is fully within the lock chamber 42, the yoke 66 closes with a normally open switch 76 providing a signal that a locking action has occurred.

Figure 7:
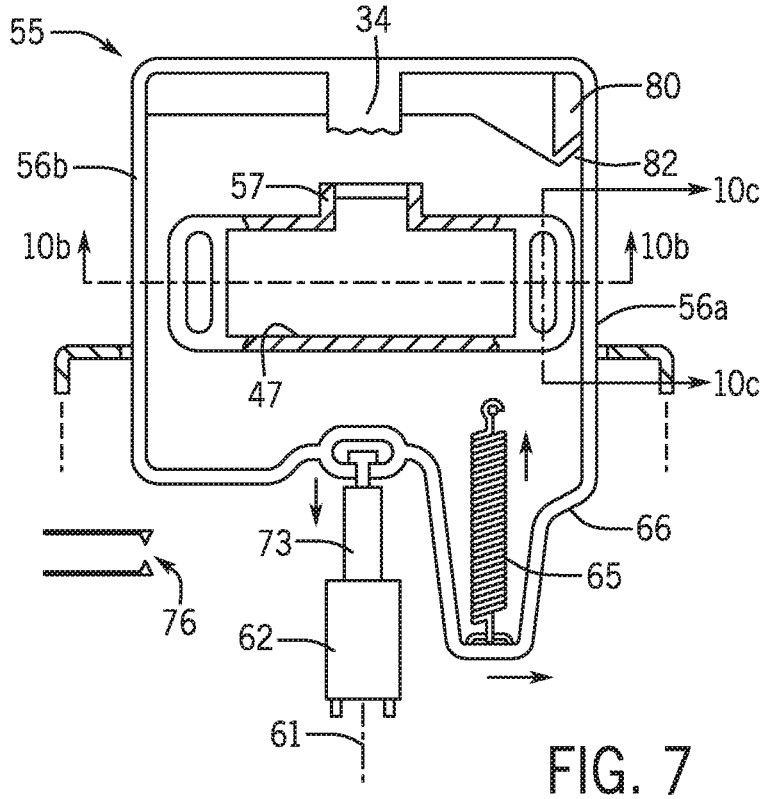
FIG. 7 is a figure similar to FIG. 6 showing a shifting of the lock pin assembly caused by the off-center spring when the lock pin is broken such as causes engagement of a primary catch feature between the housing and the lock pin assembly preventing actuation of the lock as may be detected by a switch.
Figure 8:
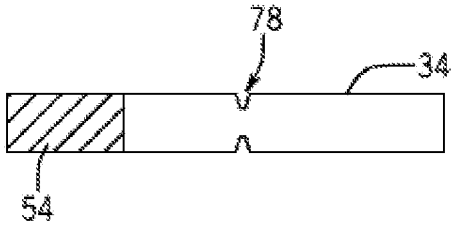
FIG. 8 is an elevational side cross section taken along line 8-8 of FIG. 6 showing a weakened portion of the lock pin promoting breakage of the lock pin at a predefined location.

Referring now to FIGS. 7 and 8, the lock pin 34 is designed with a weakened section so that any extreme force on the lock pin 34, for example, by a forcing of the door 12 open while the lock pin 34 is engaged with the strike 30, causes the lock pin 34 to reliably break at the weakened section 78. The weakened section 78 may be a thinning of the cross-section of a polymer lock pin 34 or may be the introduction of a weaker material at the location of the weakened section 78, for example, providing a region that is void of reinforcement fibers or connected by adhesive or the like. This weakened section 78 is located so that when the lock pin assembly is in the unlocked state shown in FIGS. 6 and 7, the weakened section 78 will be free of the collar 57 that normally constrains the lock pin 34 and hence the lock pin frame 55 against twisting.

Accordingly, as shown in FIG. 7, after the lock pin 34 is broken and the lock pin frame 55 moves to a lock pin retracted state, the remainder of the lock pin 34 is freed from the collar 57. During a next activation of the electrical actuator 62 to lock the lock assembly 27, asymmetrical forces of the spring 65 and the plunger 73 during activation of the electrical actuator 62 cause a twisting of the lock pin frame 55 in a counterclockwise direction 7. This twisting in turn causes an inwardly extending tooth 80 on an inner surface of sidebar 56*a* to engage with a corresponding stop 82 fixed with respect to the housing 60. This interaction of the tooth 80 and stop 82 prevents the yoke 66 from being retracted to actuate the switch 76 thus providing a clear signal that the lock pin 34 has been broken and reliable locking cannot be obtained. In this case the controller 25 may ensure that the appliance 10 does not enter into any dangerous operating states, for example, high-speed spin cycles, knowing that the door 12 cannot be securely locked to protect the consumer.

Figure 9:
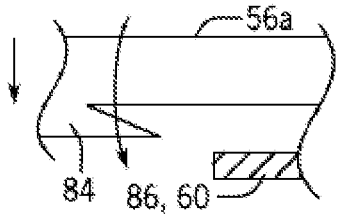
FIG. 9 is an elevational side cross section taken along line 9-9 showing a secondary catch feature between the lock pin assembly and the housing having gravitationally induced engagement.

Referring now also to FIG. 9, the interaction of tooth 80 and stop 82, under the influence of spring biasing of spring 65, is augmented by a gravitational lock-out in which a hook feature 84 extending downward from sidebar 56*a* drops downward (no longer restrained by sliding interaction of the lock pin 34 and collar 57) to catch a stop feature 86 normally positioned below and out of interference with the hook feature 84 and fixed with respect to the housing 60. Again, the interaction of the hook feature 84 and stop feature 86 prevents movement of the yoke rearward such as to close switch 76 indicating to the controller 25 that the lock pin 34 has been broken and thus that the lock is not effective in protecting the consumer.

Referring again to FIG. 7, a third mechanism for preventing the retraction of the yoke 66 when the lock pin is broken (preventing activation of the switch 76) is the misalignment between the lock pin 34 and the collar 57 such as will cause interference between these elements preventing activation of switch 76.

Referring now to FIGS. 1 and 10*a*-10*c*, sidebar 56*a* may have yet another downwardly extending tooth 90 which interacts with an upwardly biased cantilevered end of a leaf spring 92 preventing rearward motion 94 of the lock bar assembly (and sidebar 56*a*) prior to installation of the bezel 36 by the manufacturer. By blocking motion of the lock pin frame 55, shock on the lock assembly 27 during shipping cannot inadvertently move the bi-stable mechanism 68 into position where the lock pin 34 extends into the lock chamber 42 interfering with assembly and risking the possibility of breakage of the lock pin 34.

Figure 10A:
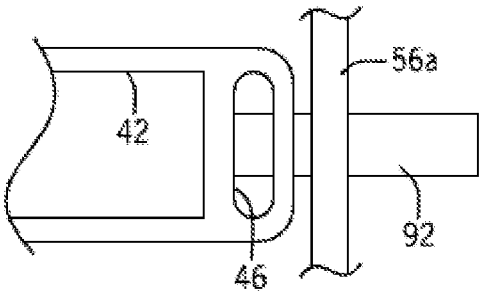
FIG. 10*a* is a fragmentary top plan view of the lock chamber showing a shipping lock spring interacting with one sidebar of the lock pin assembly to prevent movement of the lock pin assembly.
Figure 10B:
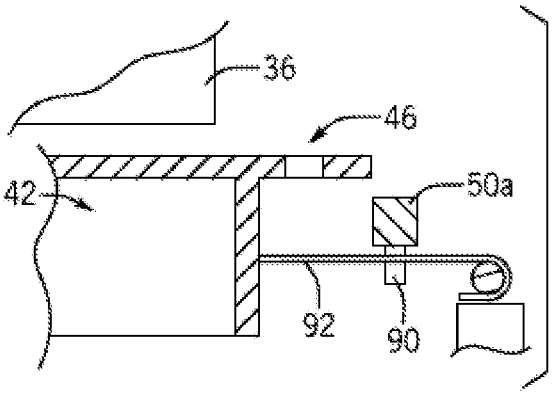
FIG. 10*b* is a fragmentary vertical cross-section taken along line 10*b*-10*b* showing interference between a tooth on the lock pin assembly and the shipping lock spring prior to assembly of the lock mechanism in an appliance.
Figure 10C:
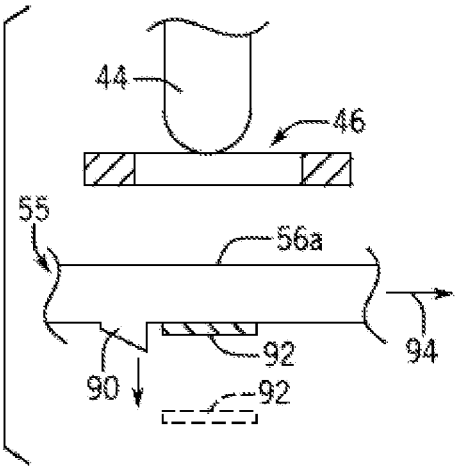
FIG. 10*c* is a vertical cross section taken along line 10*c*-10*c* showing alignment of a bezel tab with the shipping lock spring prior to installation of the bezel and further showing engagement of the shipping lock spring and a tooth on the sidebar of the lock pin assembly.
Figure 10D:
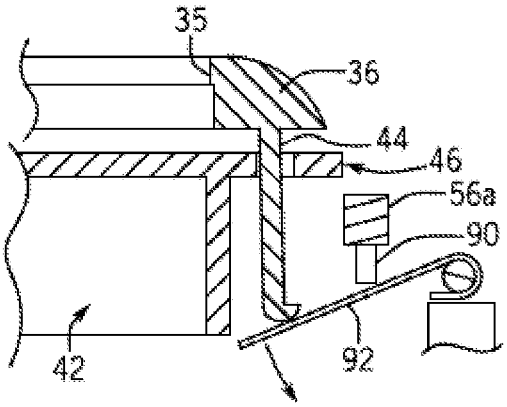
FIG. 10*d* is a figure similar to FIG. 10*b* showing engagement of the bezel with the lock mechanism such as releases the shipping lock spring.

As shown in FIGS. 10*c* and 10*d*, with installation of the bezel 36, downwardly extending locking tabs 44 of the bezel 36 pass through the tab slots 46 on either side of the lock chamber 42 and push downward on a cantilevered end of the leaf spring 92 freeing the tooth 90 and allowing free movement of the lock pin frame 55 and sidebar 56*a* for normal operation. It will be appreciated that a similar key structure, not necessarily associated with the bezel 36, may be used to unlock the lock pin frame 55, for example, by installing a similarly shaped tab through an opening at the time of manufacture.

Figure 13:
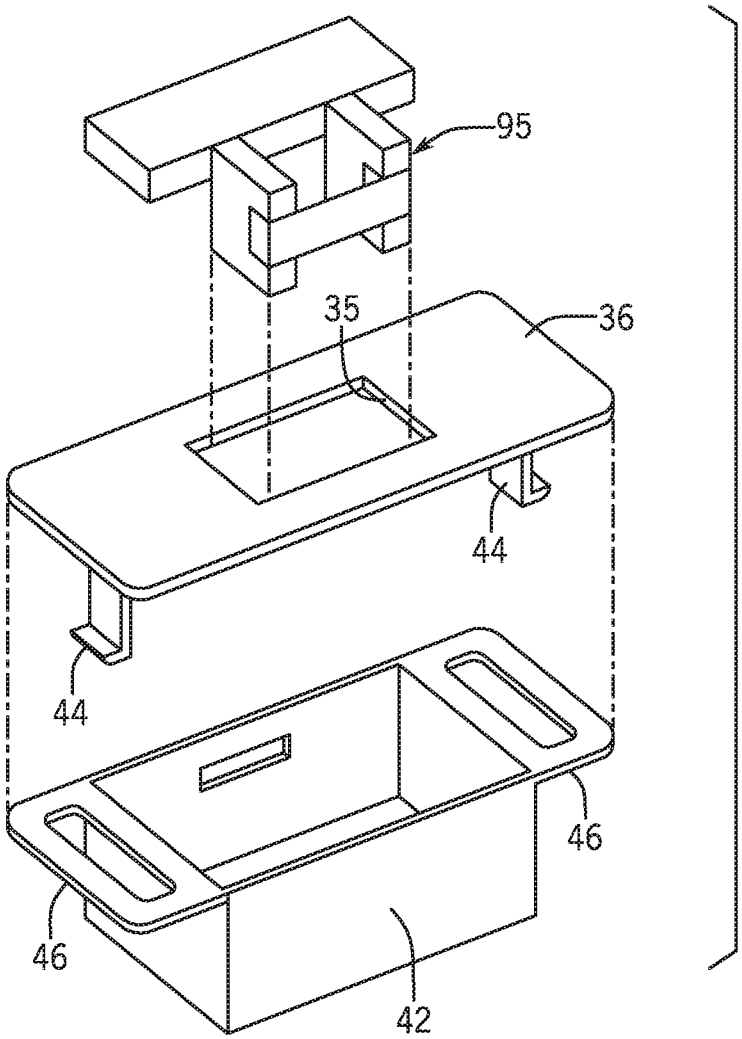
FIG. 13 is an exploded diagram of the bezel and lock chamber such as may receive a cardboard blocking element for shipping.

Referring to FIG. 13, upon completion of manufacturing, when the lock pin frame 55 is no longer restrained by the leaf spring 92, an insert 95, for example, of cardboard formed to fill the volume of the lock chamber 42, may be placed within the lock chamber 42 to prevent shipping shocks on the assembled appliance from putting the lock into a lock condition such as might prevent the consumer from accessing the interior of the washing machine during installation (the interior of the appliance holding installation instructions and a starter package). This cardboard insert 95 includes written instructions that it can be removed by the customer prior to use of the appliance. Alternatively, it will be appreciated that the insert 95 may be used to prevent shipping shocks from putting the lock into a lock condition both in shipping to the manufacturing site for installation of the lock assembly 27 and for shipping to the ultimate consumer without the need for the interlock formed by spring 92.

Figure 11:
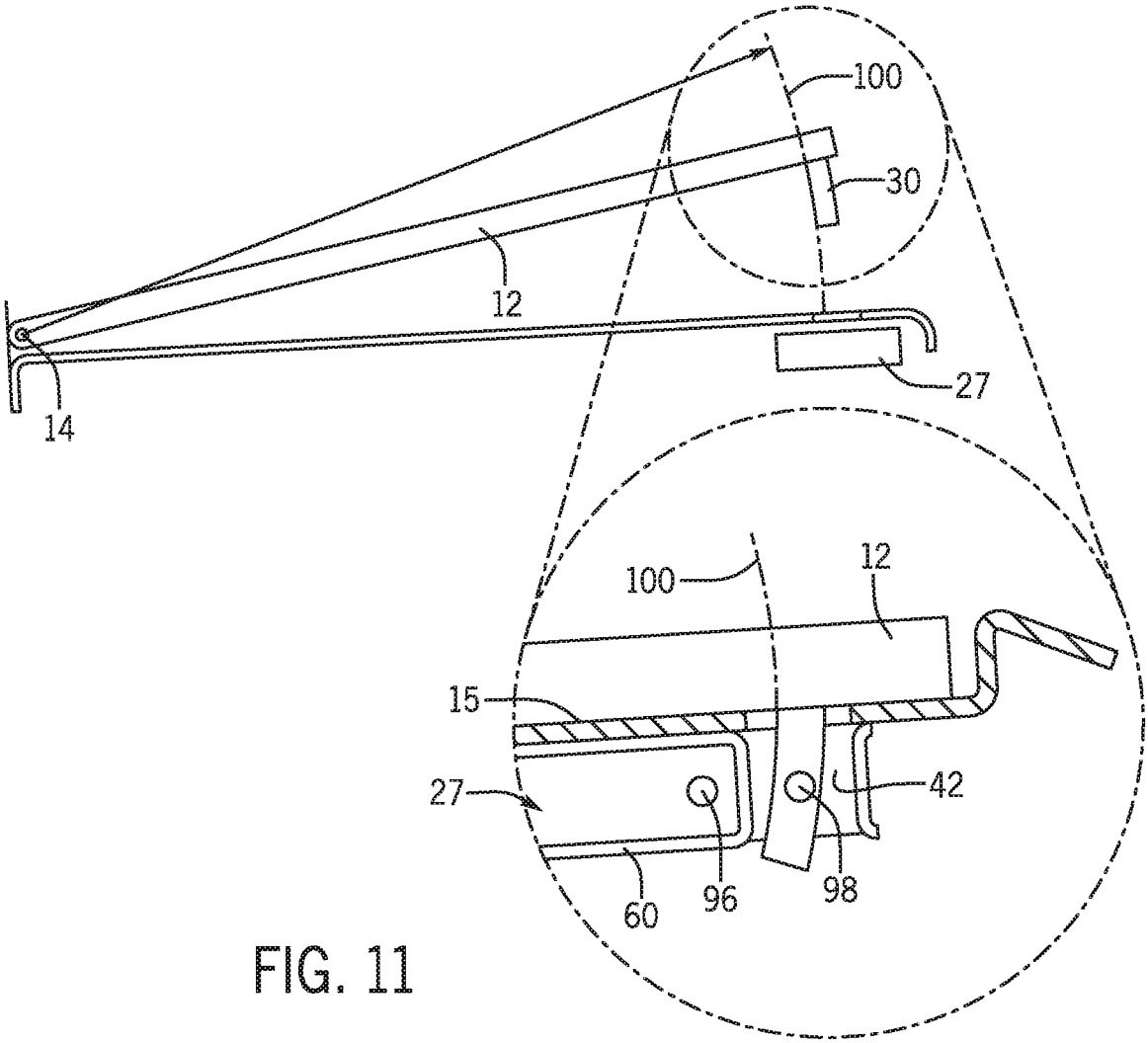
FIG. 11 is a fragmentary side view of an appliance housing and lid in partially opened configuration showing curvature of the strike to provide reduced clearance between the strike and the lock chamber for improved magnetic sensing and showing, in inset, the door in a closed configuration to provide magnetic interaction between the magnet in the strike and a reed switch in the lock assembly.
Figure 12:
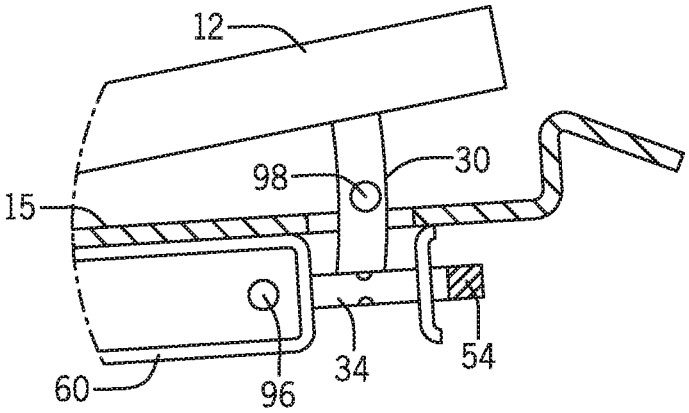
FIG. 12 is a figure similar to the inset of FIG. 11 showing a blocked closing of the door with the lock pin positioned in the lock chamber preventing triggering of the magnetic reed switch.

Referring now to FIGS. 6, 11, and 12, positioned within the housing 60 adjacent to a wall of the chamber 42 opposite the collar 57 may be a magnetic sensing reed switch 96 that can sense a corresponding magnet 98 positioned within the strike 30 thereby permitting sensing of closure of the door 12 against an upper surface of the housing 15. The use of a magnetically actuated switch makes it difficult to defeat the sensor mechanically.

The magnets 98 and the reed switch 96 are located so that if the door 12 should be blocked, for example, by a clothing item or the lock pin 34 extended as shown in FIG. 12, the magnet 98 will be sufficiently displaced from the reed switch 96 and partially blocked by the ferromagnetic steel material of the housing 15 so that reed switch 96 indicates that the door 12 is not closed, signaling an error to the controller 25 to prevent certain operations of the appliance 10, for example, such as might expose a consumer to risk if the door 12 is open based on the signal from the reed switch 96.

This ability to distinguish these two close spatial states is possible by providing a close clearance between the strike 30 and the reed switch 96 by giving the strike 30 a curvature 100 defined by a radius between the hinge axis 14 and respective inner and outer surfaces of the strike 30. This curvature allows the size of the lock chamber 42 to be reduced allowing the reed switch 96 and magnet 98 to be closer in the sensing state and thus calibrated to be more sensitive to removal of the strike 30 from that sensing state. A similar curvature may be provided to the chamber 42 so that the chamber 42 may remain in close proximity to the strike 30 throughout its opening and closing range.

Details of construction of the lock mechanism interior to the housing 60 and other aspects of the invention may make use of features described in provisional application 62/522,977 filed Jun. 21, 2017 and U.S. Pat. No. 9,528,298 both assigned to the assignee of the present invention and hereby incorporated by reference.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An appliance lock for retaining a lid strike affixed to a hinged lid of an appliance, the hinged lid opening to provide access to a washing cavity when the appliance lock is unlocked, the appliance lock comprising:

a housing providing a compartment for receiving the lid strike when the hinged lid is closed, the compartment including:

interconnected walls defining a compartment perimeter that extends about a compartment interior space and a strike opening through which the lid strike extends when the hinged lid is closed;

a lock pin adapted to slide into the compartment interior space to engage the lid strike from a first side of the compartment when the lid strike is received by the compartment;

an electric actuator communicating with the lock pin to move the lock pin along an actuation axis, the electric actuator positioned on a second side of the compartment opposite to the first side and is outside of the compartment interior space; and a linkage connecting the lock pin to the electric actuator with the linkage extending parallel to the actuation axis and transversely spaced from the strike opening.

2. The appliance lock of claim 1 wherein the linkage extends away from the electric actuator along a first direction within a plane of the actuation axis and wherein the lock pin attaches to the linkage to extend along a second direction within the plane of the actuation axis opposite the first direction.

3. The appliance lock of claim 2 wherein the linkage provides a lock pin frame with first and second linkage arms together flanking the lock pin and passing on opposite sides of the compartment, the lock pin frame including a crossbar connecting the first and second linkage arms to each other with the lock pin cantilevered from the crossbar and wherein each of first and second linkage arms and the crossbar are arranged outwardly of the strike opening.

4. The appliance lock of claim 2 wherein the lock pin and linkage have lower surfaces that extend along parallel planes.

5. The appliance lock of claim 1 wherein the interconnected walls of the compartment are upstanding sidewalls extending about the compartment interior space defining a volume therebetween with only a single opening through one of the upstanding sidewalls at the first side of the compartment opposite the electric actuator, that opening for admitting the lock pin.

6. The appliance lock of claim 1 wherein the compartment is open at a bottom and the compartment interior space is separated from the electric actuator by an unbroken vertical wall.

7. An appliance lock for retaining a lid strike affixed to a hinged lid of an appliance, the hinged lid opening to provide access to a washing cavity when the appliance lock is unlocked, the appliance lock comprising:

a lock pin assembly having a lock pin movable between a first position, engaging the lid strike when the lid strike is positioned proximate to the lock pin, and a second position, disengaging from the lid strike when the lid strike is positioned proximate to the lock pin, causing the appliance lock to be unlocked;

an electric actuator communicating with the lock pin to move the lock pin between the first and second positions; and a safety catch arranged inside the housing, the safety catch having a stop surface that is misaligned to avoid contact with a segment of the lock pin assembly during a normal operation of appliance lock and aligns with the segment of the lock pin assembly and blocks movement of the lock pin assembly from moving to the first position from the second position when the lock pin is damaged.

8. The appliance lock of claim 7 wherein the safety catch and lock pin assembly are biased into engagement by gravity.

9. The appliance lock of claim 7 further comprising an electrical switch communicating with the lock pin, indicating failure of the lock pin to fully extend to the second position when the movement of the lock pin assembly is blocked by the safety catch.

10. The appliance lock of claim 7 wherein the electric actuator is a solenoid.

11. An appliance lock for retaining a lid strike affixed to a hinged lid of an appliance, the hinged lid opening to provide access to a washing cavity when the appliance lock is unlocked, the appliance lock comprising:

a lock pin assembly having a lock pin movable between a first position, engaging the lid strike when the lid strike is positioned proximate to the lock pin, and a second position, disengaging from the lid strike when the lid strike is positioned proximate to the lock pin, causing the appliance lock to be unlocked;

an electric actuator communicating with the lock pin to move the lock pin between the first and second positions;

a safety catch blocking movement of the lock pin assembly from moving to the first position from the second position when the lock pin is damaged; and wherein the lock pin includes a weakened section promoting breakage at a predetermined location, and wherein the breakage of the lock pin at the weakened section allows relative movement of the lock pin assembly and safety catch, so that the safety catch engages with the lock pin assembly when the electric actuator is actuated to move the lock pin, thereby limiting movement of the lock pin assembly.

12. The appliance lock of claim 11 wherein the safety catch and lock pin assembly are biased into engagement under influence of a spring when the lock pin is broken.

13. The appliance lock of claim 12 wherein the spring biases the lock pin into the second position.

14. The appliance lock of claim 13 wherein the spring is positioned offset from a line of action of the actuator to impart a torsion to the lock pin assembly causing engagement of the safety catch and lock pin assembly when the lock pin is broken.

15. The appliance lock of claim 14 wherein the safety catch is a portion of an aperture through which the lock pin passes.

16. An appliance lock for retaining a lid strike affixed to a hinged lid of an appliance, the hinged lid opening to provide access to a washing cavity when the appliance lock is unlocked, the appliance lock comprising:

a lock pin movable between a first position, engaging the lid strike positioned proximate to the lock pin, and a second position, disengaging from the lid strike positioned proximate to the lock pin, causing the lock to be unlocked;

a bi-stable electrical actuator assembly for moving the lock pin between the first and second positions upon successive activations of the bi-stable electrical actuator assembly;

a lock pin stop blocking movement of the lock pin from the second position to the first position in a shipping state of the appliance lock when the lock pin stop is in a shipping position, and allowing movement of the lock pin from the second position to the first position in an assembled state of the appliance lock when the lock pin stop is a use position; and a key structure spaced from the lid strike and interacting with the lock pin stop to move the lock pin stop from the shipping position to the use position by engagement of the key structure with the lock pin stop.

17. An appliance lock for retaining a lid strike affixed to a hinged lid of an appliance, the hinged lid opening to provide access to a washing cavity when the appliance lock is unlocked, the appliance lock comprising:

a lock pin movable between a first position, engaging the lid strike positioned proximate to the lock pin, and a second position, disengaging from the lid strike positioned proximate to the lock pin, causing the lock to be unlocked;

a bi-stable electrical actuator assembly for moving the lock pin between the first and second positions upon successive activations of the bi-stable electrical actuator assembly;

a lock pin stop blocking movement of the lock pin from the second position to the first position in a shipping state, and allowing movement of the lock pin from the second position to the first position in an assembled state;

a key structure interacting with the lock pin stop to move the lock pin stop from the shipping state to the assembled state; and wherein the key structure is a feature on a bezel attached to the appliance lock when the appliance lock is installed on the appliance to provide an opening through which the lid strike may pass when the hinged lid of the appliance is closed and the lid strike moves to the position proximate to the lock pin.

18. An appliance lock for retaining a lid strike affixed to a hinged lid of an appliance, the hinged lid opening to provide access to a washing cavity when the appliance lock is unlocked, the appliance lock comprising:

a lock pin movable between a first position, engaging the lid strike positioned proximate to the lock pin, and a second position, disengaging from the lid strike positioned proximate to the lock pin, causing the lock to be unlocked;

a bi-stable electrical actuator assembly for moving the lock pin between the first and second positions upon successive activations of the bi-stable electrical actuator assembly;

a lock pin stop blocking movement of the lock pin from the second position to the first position in a shipping state of the appliance lock when the lock pin stop is in a shipping position, and allowing movement of the lock pin from the second position to the first position in an assembled state of the appliance lock when the lock pin stop is a use position;

a key structure interacting with the lock pin stop to move the lock pin stop from the shipping position to the use position by engagement of the key structure with the lock pin stop; and wherein the lock pin engages the lid strike in the first position within a partially enclosed compartment, and the appliance lock further including a stop removably positionable within the compartment and located proximate to the lock pin for blocking extension of the lock pin to the first position.

19. An appliance lock for retaining a lid strike attached to a hinged lid of an appliance, the hinged lid opening by pivoting about a hinge axis to provide access to a washing cavity when the appliance lock is unlocked, the appliance lock comprising:

the lid strike, wherein the lid strike extends in a direction perpendicular to the hinge axis and holds a magnet; a lock pin movable between a first position, engaging the lid strike when the lid strike is at a predetermined position proximate to the lock pin, and a second position, disengaging from the lid strike when the lid strike is at the predetermined position proximate to the lock pin;

a lock chamber with a first opening that receives the lid strike and a second opening that receives the lock pin; and a strike sensor mounted adjacent the lock chamber, closer to the first opening of the lock chamber than the second opening of the lock chamber, and providing a magnet on the lid strike for being sensed by the strike sensor to indicate a position of the lid strike when the lid strike is located at the predetermined position proximate to the lock pin so as to be engaged by the lock pin, and wherein the strike sensor and magnet are positioned so that the strike sensor does not sense a position of the lid strike when the lid strike is blocked from moving to the predetermined position proximate to the lock pin by an engagement between the lock pin and the lid strike that holds the magnet out of the lock chamber.

20. The appliance lock of claim 19 wherein the lid strike has a curved body with a curvature following a constant radius about the hinge axis.

* * * * *